US008991599B2

(12) United States Patent
Wilson

(10) Patent No.: US 8,991,599 B2
(45) Date of Patent: Mar. 31, 2015

(54) POP-UP TOOL CARRIER

(76) Inventor: Roger F. Wilson, Sarasota, FL (US)

( * ) Notice: Subject to any disclaimer, the term of this patent is extended or adjusted under 35 U.S.C. 154(b) by 826 days.

(21) Appl. No.: 12/965,027

(22) Filed: Dec. 10, 2010

(65) Prior Publication Data

US 2012/0145582 A1 Jun. 14, 2012

(51) Int. Cl.
*B65D 85/28* (2006.01)
*B25H 3/06* (2006.01)
*B25H 3/02* (2006.01)

(52) U.S. Cl.
CPC ..... *B25H 3/06* (2013.01); *B25H 3/026* (2013.01); *Y10S 312/902* (2013.01)
USPC ..... 206/373; 312/205; 312/902; 108/145

(58) Field of Classification Search
CPC ..... B25H 3/02; B25H 3/023; B25H 3/003
USPC ..... 206/372, 373, 736, 740, 743, 744, 745, 206/747, 748, 759, 45.24, 764; 312/205, 312/902; 108/99, 145, 118, 147.11; 248/564, 567, 588, 590, 591, 592, 595, 248/596
See application file for complete search history.

(56) References Cited

U.S. PATENT DOCUMENTS 739,451 A * 9/1903 Schwartz ..... 312/328
1,118,326 A * 11/1914 Braen ..... 190/17
1,131,128 A * 3/1915 Goodman ..... 312/272
1,284,322 A * 11/1918 Hammond ..... 220/520
1,541,211 A * 6/1925 Ford ..... 220/23.83
1,893,526 A * 1/1933 Shriver ..... 312/266
2,069,661 A * 2/1937 Tiede ..... 43/57.2
2,203,008 A * 6/1940 Bauman ..... 312/309
2,488,067 A * 11/1949 Roark ..... 312/200
2,645,538 A * 7/1953 Segal ..... 108/145
2,650,150 A * 8/1953 Smith et al. ..... 312/201
2,710,093 A * 6/1955 Raker ..... 312/244
2,772,003 A * 11/1956 Volz ..... 211/130.1
2,995,409 A * 8/1961 Simonsen ..... 312/325
3,410,018 A * 11/1968 Woolworth ..... 43/26
3,606,511 A * 9/1971 Henning ..... 312/266
3,612,635 A 10/1971 Uyeda et al.
3,985,409 A * 10/1976 Kneier ..... 312/271
4,173,284 A * 11/1979 March ..... 206/349
4,621,308 A * 11/1986 Holmberg et al. ..... 362/154
4,706,817 A * 11/1987 Greathouse ..... 206/545
4,739,577 A * 4/1988 Lanius ..... 43/54.1
4,863,042 A * 9/1989 Rohner ..... 211/11
5,611,170 A * 3/1997 McGuff et al. ..... 43/57.1
6,267,484 B1 7/2001 Baker et al.
6,318,713 B1 * 11/2001 Levi ..... 269/139
7,168,773 B1 * 1/2007 Emary ..... 312/246
7,278,234 B2 * 10/2007 Marino ..... 43/54.1
2002/0078866 A1 * 6/2002 Palmer ..... 108/145

(Continued)

*Primary Examiner* — Jacob K Ackun
*Assistant Examiner* — Jenine Pagan
(74) *Attorney, Agent, or Firm* — Caesar, Rivise, Bernstein, Cohen & Pokotilow, Ltd.

(57) ABSTRACT

A device for holding and carrying various items, e.g., hand tools or other small items, is disclosed. It includes a lower tray, an upper tray, a pair of foldable strut assemblies and a handle. Each strut assembly includes a pair of leg sections pivotably connected together. The strut assemblies are located at diagonally located corners of the trays with their leg sections arranged to be pivoted to an open position, whereupon the upper tray is spaced above said lower tray to provide ready access to any items in said lower tray. Torsion springs are provided to hold the tray in that position.

19 Claims, 7 Drawing Sheets

(56) References Cited

U.S. PATENT DOCUMENTS

2002/0179181 A1 12/2002 Murphy
2004/0168941 A1* 9/2004 Cho ..... 206/373
2006/0037873 A1 2/2006 Elgart
2006/0118460 A1* 6/2006 McKenzie et al. ..... 206/748
2007/0273114 A1* 11/2007 Katz ..... 280/47.18
2010/0314271 A1* 12/2010 Baruch ..... 206/349

* cited by examiner

Fig. 1
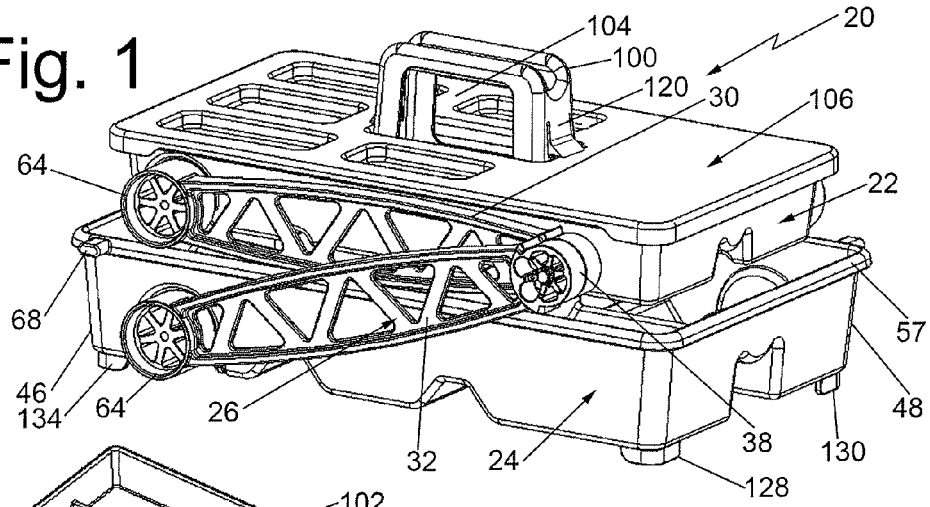
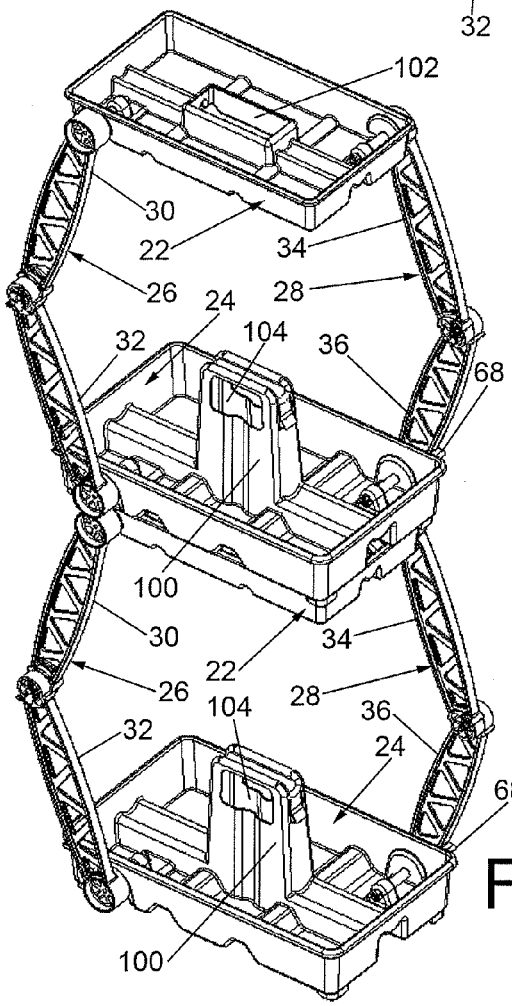
Fig. 2B
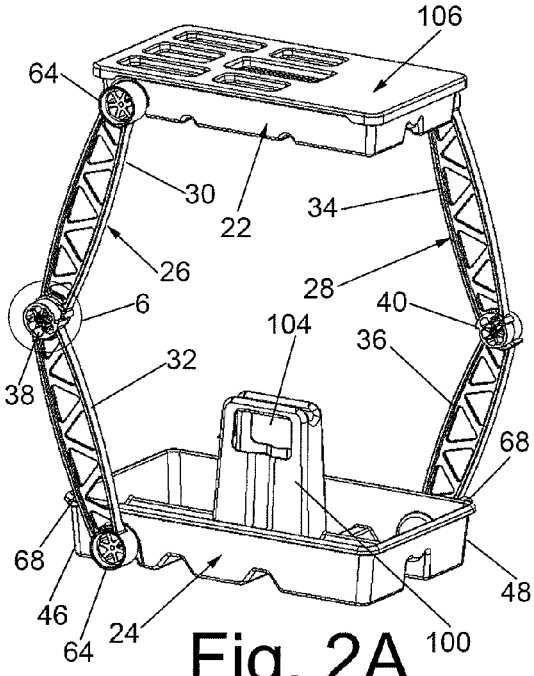
Fig. 2A

POP-UP TOOL CARRIER

BACKGROUND OF THE INVENTION

This invention relates generally to carriers for hand tools and other small items and more particularly to carriers with multiple storage trays including means to quickly and easily pop up the top tray to a height that provides easy access, e.g., is comfortable for a standing person to access.

Tool carriers, portable storage boxes, tackle boxes, and simple open carriers and totes, made of wood and now common in plastic or metal have been around for a very long time. More recent examples of such boxes are shown in the patent literature. See for example, U.S. Pat. Nos. 3,612,635 (Uyeda et al.), 5,611,170 (McGuff et al.), and 6,267,484 (Baker et al.), which disclose tackle or tool boxes having plural trays which are arranged to be moved between a collapse or closed position and an extended or open position and vice versa. While such boxes may be generally suitable for their intended purposes, they nevertheless leave much to be desired from the standpoints of the range of function, compactness and convenience of use. For example, the extendable trays of those boxes are not capable of elevation to heights readily accessible by a standing user (unless the entire box is disposed at an elevated height, e.g., placed on a table or workbench).

The use of collapsible/extendable legs on work tables or carts has also been known for a very long period of time. See for example U.S. Applications 2002/0179181A1 and 2006/0037873A1. However, such tables or carts are somewhat limited in their range of extension and compactness. Thus, they are not readily portable to carry hand tools or other small items.

The subject invention addresses those needs by providing a device including at least one tray which is readily portable for carrying hand tools or other small items, and which can be placed on the ground or on some other low surface, with the at least one tray being arranged to be elevated to a comfortable and convenient working height for a standing user.

SUMMARY OF THE INVENTION

In accordance with one aspect of this invention there is provided a device for holding and carrying various items. The device basically comprises a lower tray, an upper tray, a first strut assembly, a second strut assembly, and a handle that is connected to one of the trays. The strut assemblies are coupled between the lower tray and the upper tray. Each of the strut assemblies has an upper end portion and a lower end portion and comprises a pair of strut or leg sections pivotably connected together. The upper end portion of the first strut assembly is pivotably connected to a first portion of the upper tray, while the upper end portion of the second strut assembly is pivotably connected to a second portion of the upper tray. The second portion of the upper tray is located diagonally to the first portion of the upper tray. The lower end portion of the first strut assembly is pivotably connected to a first portion of the lower tray. In a similar manner the lower end portion of the second strut assembly is pivotably connected to a second portion of the lower tray. The second portion of the lower tray is located diagonally to the first portion of the lower tray.

The strut sections of each of the strut assemblies are pivotably connected together at a knee joint and are arranged to pivot with respect to each other in a first rotational direction to an extended or open position. In the open position the upper tray is spaced above the lower tray to provide ready access to items in the lower tray. The strut sections are also arranged to pivot with respect to each other in a second and opposite rotational direction to a retracted or closed position. In the closed position the upper tray is in close proximity to the lower tray to prevent items in the lower tray from accidentally falling out of the lower tray. The handle is arranged to facilitate the carrying of the device when the trays are in the closed position.

In accordance with one preferred aspect of this invention each of the leg (strut) sections of the strut assemblies is of identical (i.e., modular) construction in the interests of simplicity of construction and concomitant cost reduction.

In accordance with another preferred aspect of this invention the leg (strut) sections are spring loaded in order to assist in deploying the device into the open position and to increase stability in the open position.

In accordance with another preferred aspect of the invention the handle is centrally positioned and integral to the bottom tray and extends thru the upper tray to simplify structural demand on the system when transporting loaded trays.

In accordance with another preferred aspect of the invention a lid is provided for the upper tray, with the lid having multiple recesses or depressions to retaining and sorting various small articles, e.g., such as screws, nuts, etc., and a flat surface area for enabling one to write thereon.

In accordance with another preferred aspect of the invention a latch is provided to ensure and maintain the device in its closed or collapsed position.

In accordance with another preferred aspect of the invention the strut sections attached to the upper tray rest against a rim on the lower tray's rim's upper surface when the device is in the collapsed position.

In accordance with another preferred aspect of the invention the bottom of one device is constructed so that it may readily be stacked on a similar device to achieve a greater working height. Moreover, the bottom surface of the lower tray includes geometry, e.g., feet, to fit or mate with portions of an upper tray of another similar device when the devices are stacked.

In accordance with another preferred aspect of the invention the connection of a strut section to a tray is accomplished by means of an axle which is of sufficient length and integrated or securely attached to the strut section to mate with portion of the tray.

DESCRIPTION OF THE DRAWING

FIG. 1 is an isometric view from the top showing one exemplary embodiment of a device (e.g., a device having an upper tray and a lower tray) constructed in accordance with the subject invention in its collapsed or closed position or state;

FIG. 2A is an isometric view, similar to FIG. 1, but showing the device of FIG. 1 in its open extended or open position or state;

FIG. 2B is an isometric view, similar to FIG. 2A, but showing two devices of FIG. 2A stacked on each other in their open position or state;

DETAILED DESCRIPTION OF THE PREFERRED EMBODIMENT

Figure 3:
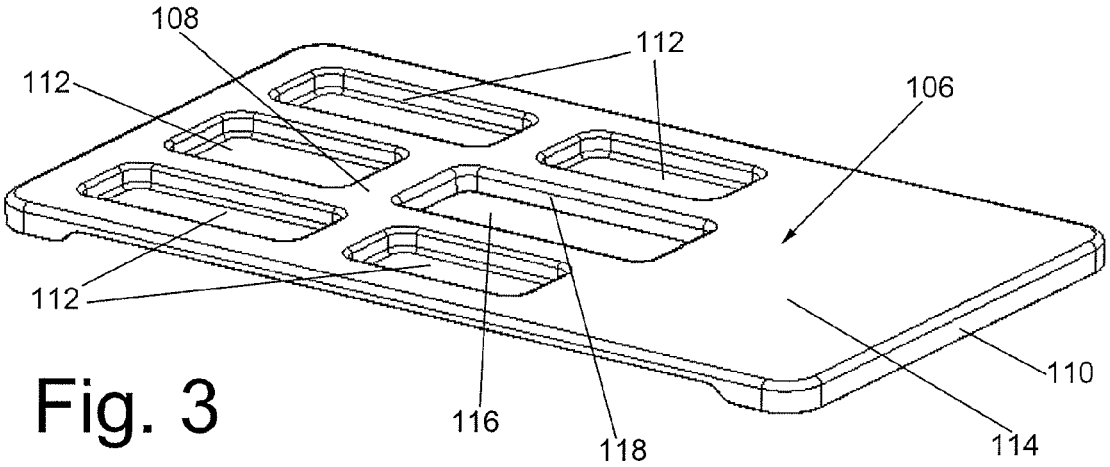
FIG. 3 is an isometric view, taken from the top, of a cover forming a portion of the device shown in FIG. 1 for closing off the upper tray of that device.

Referring now to the various figures of the drawing wherein like reference characters refer to like parts, there is shown at 20 in FIG. 1 an exemplary embodiment of a carrier or tote device constructed in accordance with this invention. The device 20 basically comprises a pair of trays, i.e., an upper tray 22 and a lower tray 24, each of which is arranged to portably hold hand tools or other small items (not shown) therein. Each tray is of a general rectangular shape, but other shaped trays can be used as well. The trays can be formed of any suitable material, e.g., plastic, metal, wood or any combination thereof. The details of the trays 22 and 24 will be described later. Suffice it for now to state that each includes a bottom wall 60 and peripheral sidewall 52 (both to be described later) defining and bounding a hollow interior which is divided into sections to facilitate the holding of various hand tools or small items, e.g., hardware, etc., in sorted regions. In the exemplary embodiment shown, the lower or primary tray 24, serves as the base for the device to support the device on any horizontal surface, e.g., the ground.

The trays 22 and 24 are connected together by a pair of extendable/retractable leg or strut assemblies 26 and 28 to enable the trays of the device 20 to be extended from a compact or closed state, like shown in FIG. 1, wherein the tools or items are enclosed within the trays of the device so that they cannot accidentally fall out, to an extended or open state like shown in FIG. 2A. The strut assemblies 26 and 28 are of identical construction to each other as will be described in detail later.

In accordance with one preferred aspect of the invention, the strut assemblies are constructed and sized so that when the upper tray 22 is in the extended or open position/state it is disposed and held sufficiently above the lower tray 24 so that if the lower tray is placed on the ground or some other low surface the upper tray will be at a height which can be conveniently and comfortably reached by a standing or sitting user. As should be apparent, the extension of the upper tray to its open position also enables ready access to the contents of the lower tray, since the upper tray will no longer be juxtaposed immediately above the lower tray.

As will be seen from the discussion to follow, the strut assemblies 26 and 28 are constructed so that when the device is in its open or extended position it is very stable, e.g., resistant to accidental collapse. However, even in the stable open state, the device is still capable of being manually collapsed by the user to the compact state shown in FIG. 1, such as when it is desired to carry the device to some other working or storage location.

In the interest of minimizing complexity, manufacturing costs, and to enhance ease of use, the preferred embodiment of the device 20 utilizes only two leg assemblies (instead of the typical four). Those assemblies are situated at corners of the device diagonally opposite each other. Each assembly comprises two sections, e.g., legs 30 and 32 of assembly 26, and legs 34 and 36 of assembly 28. Each section is an elongated member that has one end connected respectively with either the top or bottom tray, and one end connected to the adjoining section at what is hereforth referred to as the knee or pivotable joint (to be described later) to enable those sections to fold with respect to each other.

Preferably the folding leg sections are spring loaded in order to assist in deploying the invention into the open or extended position and to increase stability in the extended position. To that end, each knee joint includes a torsion spring (to be described later). Moreover, rotational stops (also to be described later) are provided in the knee joint and on the lower tray so that when the device in the fully deployed or extended/open position the leg sections encounter those stops to maintain the device in that position. The springs serve to bias the associated leg sections into an extended over-center position that ultimately helps lock them against the rotational stops. Assuming a somewhat vertical orientation of the device 20, the springs help with deployment and work in conjunction with gravity help maintain the device in the extended position and ultimately reasonably stable position of the upper tray.

In operation (to be described later) the collapsing of the upper tray to the compact or closed position involves the operator holding the upper tray while biasing the two leg assemblies towards each other inwardly against the springs. Once the legs are folded to a small degree inwardly one simple lowers the upper tray while the legs continue folding and retracting into a compact orientation alongside the trays.

Figure 5:
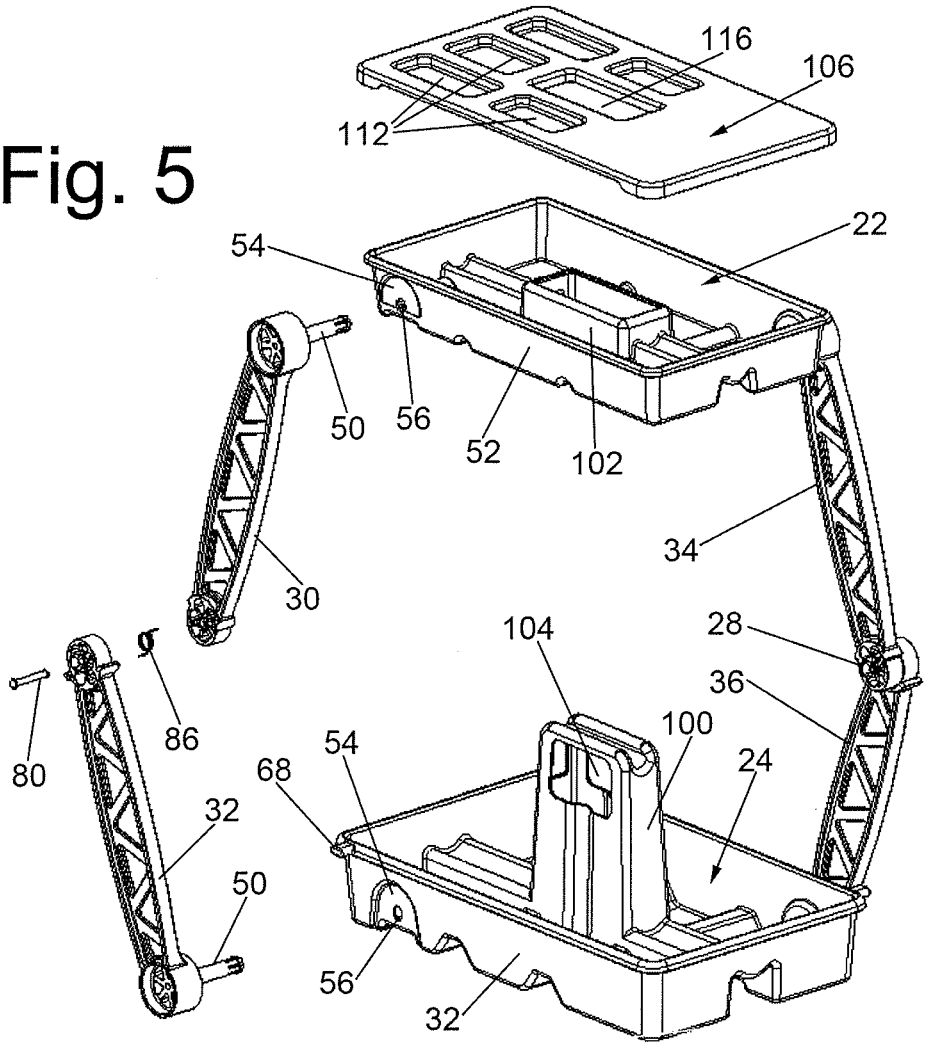
FIG. 5 is a partially exploded isometric view, taken from the top, showing the embodiment of the device shown in FIG. 2A.

Referring now to FIGS. 1, 2A and 5, it can be seen that each of the sections of each strut assembly is preferably modular (i.e., identical in construction), in the interest of simplicity and reduced component costs. Like the trays, the leg sections can be formed of any suitable materials. It should be pointed out at this juncture that the leg sections of the strut assemblies can differ in construction, size and material, if desired, e.g., the length of the leg sections 30 and 34 may be different than the length of the leg sections 32 and 36. In any case, the leg sections 30 and 32 of the strut assembly 26 are pivotably connected to each other by a pivotable joint 38 (to be described later), while the leg sections 34 and 36 of the strut assembly 28 are pivotably connected to each other by a pivotable joint 40 (also to be described later).

Figure 8:
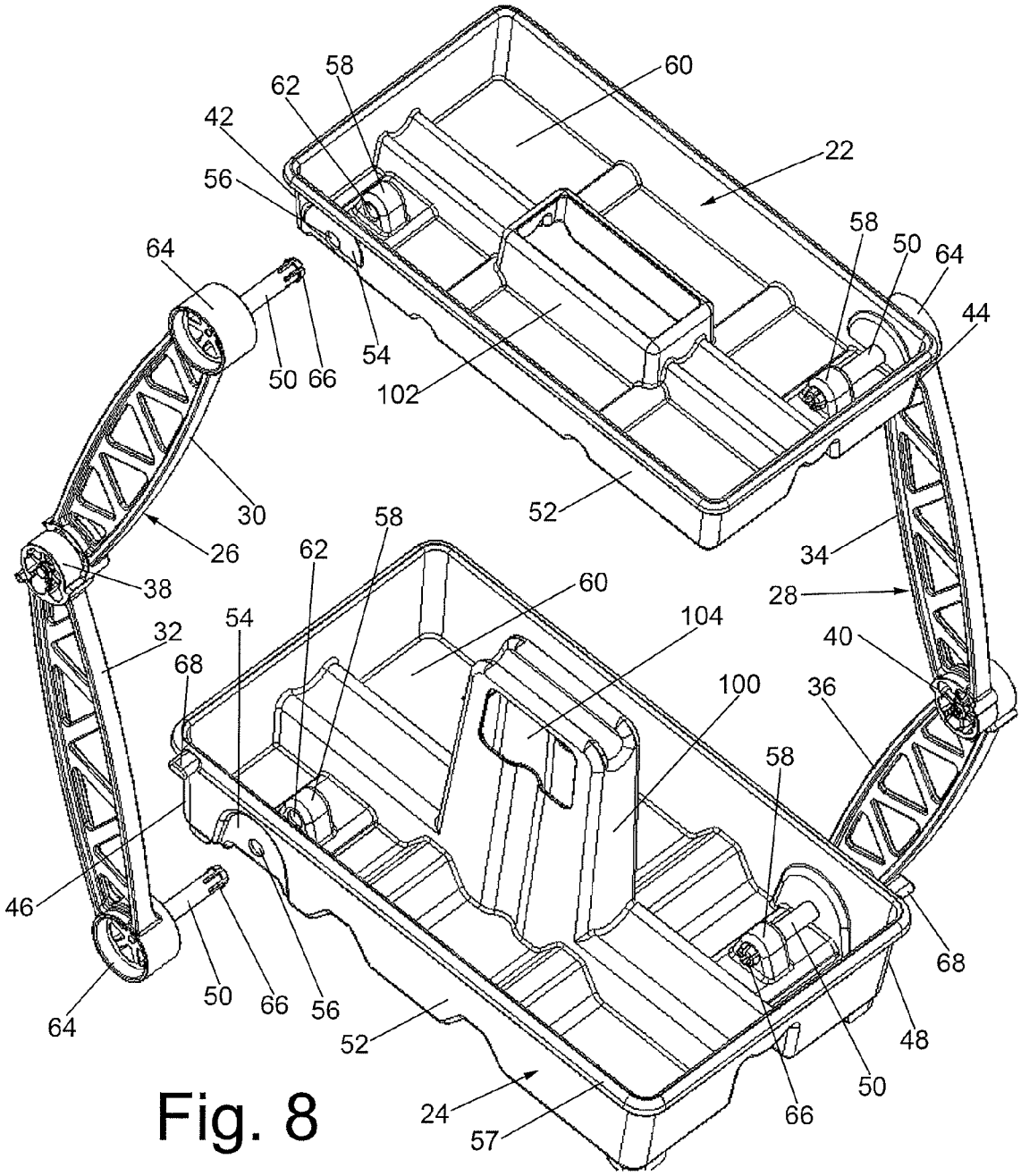
FIG. 8 is a partially exploded isometric view of the device of FIG. 2A, but without the cover on its upper tray.

In order to minimize the number of components required to connect the two trays together so that they can be extended/retraced with respect to each other, the strut assemblies 26 and 28 are preferably located at opposite diagonal corners of the trays as mentioned above. This diagonal arrangement also aids in providing stability for the trays and facilitates the collapsing of the trays to the closed position shown in FIG. 1. To that end, as best seen in FIGS. 2A and 8, the upper end of the leg section 30 is pivotably connected to the upper tray 22 at one corner 42, while the upper end of the leg section 34 is pivotably connected to the upper tray at another corner 44. The corner 44 is disposed diagonally to the corner 42. In a similar manner, the lower end of the leg section 32 is pivotably connected to the lower tray 24 at one corner 46, while the lower end of the leg section 36 is pivotably connected to the lower tray 24 at another corner 48. The corner 48 is disposed diagonally to the corner 46. The corner 48 is located below and slightly laterally of the corner 44, while the corner 46 is located below and slightly laterally of the corner 42.

Turning now to FIGS. 5, 8, 9 and 10 the details of the pivotable connection of the leg sections to the trays will now be described. Each of those connections is accomplished in the same manner. Thus, in the interest of brevity only the connection of the leg section 32 of leg assembly 26 to the tray 24 will be described. In particular, as can be seen the lower end of the lower leg section 32 of the leg assembly 26 includes an axle 50 projecting therefrom. The sidewall 52 of the lower tray 24 includes a semicircular recess or depression 54. A hole 56 is located at the center of the recess 54. A rim or flange 57 forms the top peripheral edge of the sidewall 54. An ear 58 projects up from the bottom wall 60 of the tray 24 immediately behind the depression 54 in the sidewall 52. The ear includes a pair of axially aligned holes, only one of which, 62 can be seen in FIG. 9. The holes in the ear are axially aligned with the hole 56 in the sidewall. The lower end of leg section 32 is in the form of a circular ring-like structure 64, with the axle 50 projecting perpendicularly from the center thereof. The outside diameter of the axle 50 is slightly less than the inside diameter of the axially aligned holes so that it may be received therein and able to rotate about the axis of the aligned holes. The free end of the axle includes plural resilient barbed fingers 66 for holding the axle in place in the aligned holes, thereby completing the pivotable connection. As should be recognized by those skilled in the art the stability of the axle 50 within the aligned holes in the multiple support walls, i.e., the sidewall 52 and the walls of the ear 58, far exceeds that which would be achieved with the axle passing through a single wall, e.g., the sidewall 52, alone. This arrangement helps considerably in managing the elevated height of the device with the use of just two leg assemblies.

Figure 10:
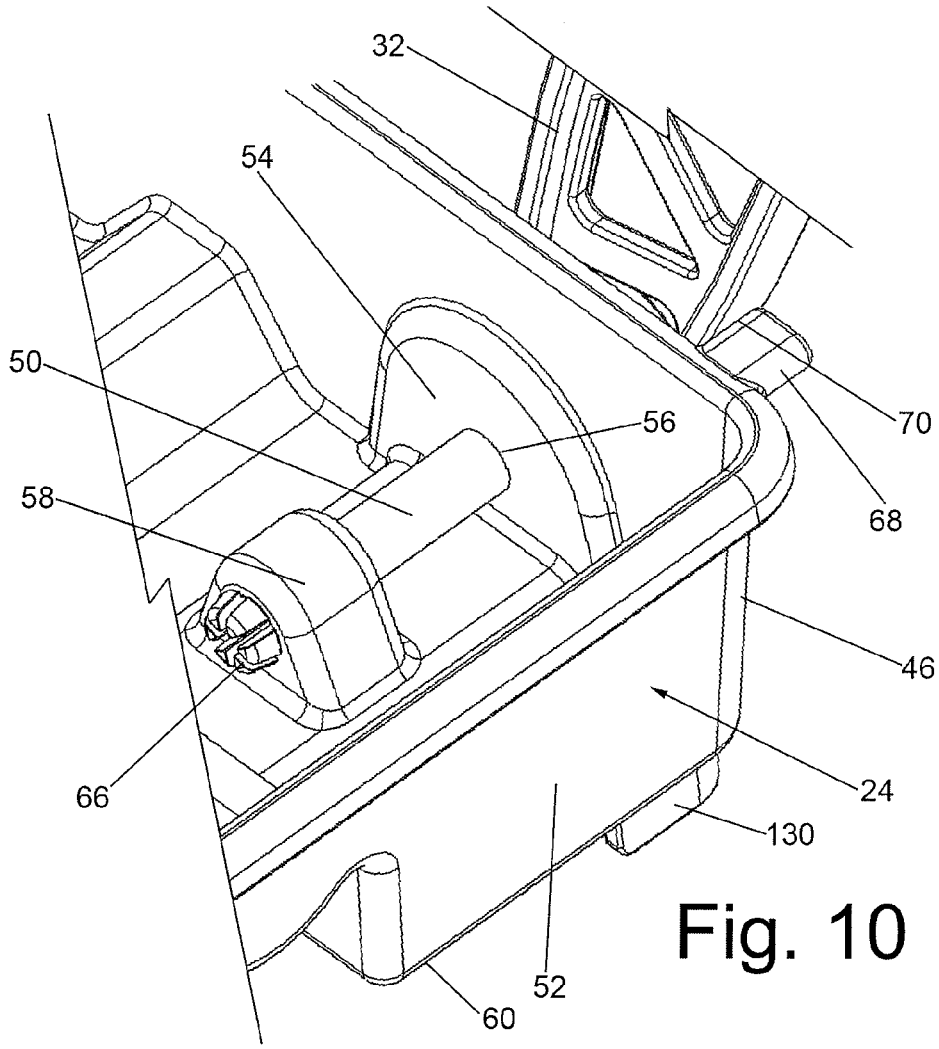
FIG. 10 is an enlarged isometric view taken from a different direction showing the connection between the lower end of one strut assembly to the lower tray of the device of FIGS. 1, 2A and 2B.

In order to restrict the leg sections to a predetermined range of pivotable movement and thus insure stability of the trays when the device is in the open or extended position/state, the device 20 includes the heretofore mentioned stops. For example, as best seen in FIG. 10, a stop 68 projects outward from the sidewall 52 of the tray 24 at corner 46. The stop 68 is arranged to be engaged by a portion 70 of the leg section 32 when that leg section rotate in the counterclockwise direction to extend the device 20 to its open position. Thus, continuous counterclockwise rotation (over-rotation) of the leg section 32 is prevented. The lower leg section 36 of leg assembly 28 is similarly connected to the lower tray 24 adjacent the corner 48. The rotational stops 68 of the lower tray 24 in combination with stops (to be described shortly) at the knee joints 38 and 40 create a vertically oriented stability of the leg assemblies in the extended position such that additional means or stops is eliminated (e.g., stops for the upper tray 22 are unnecessary).

Figure 6:
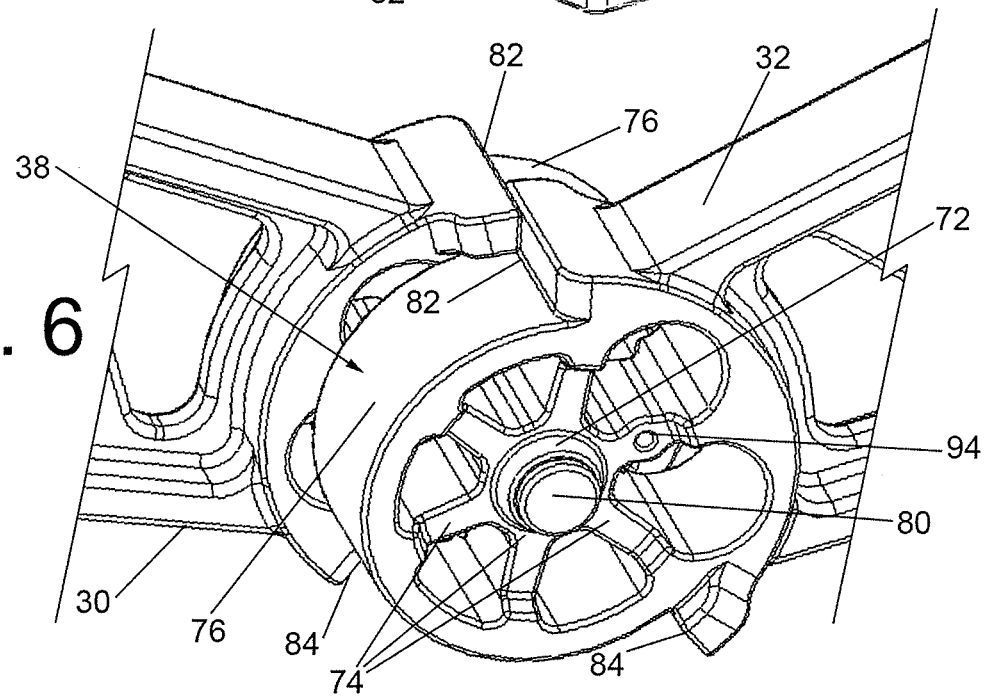
FIG. 6 is an enlarged isometric view of a portion, i.e., a knee joint of a typical strut assembly (to be described later), shown within the circular area 6 in FIG. 2A.
Figure 7:
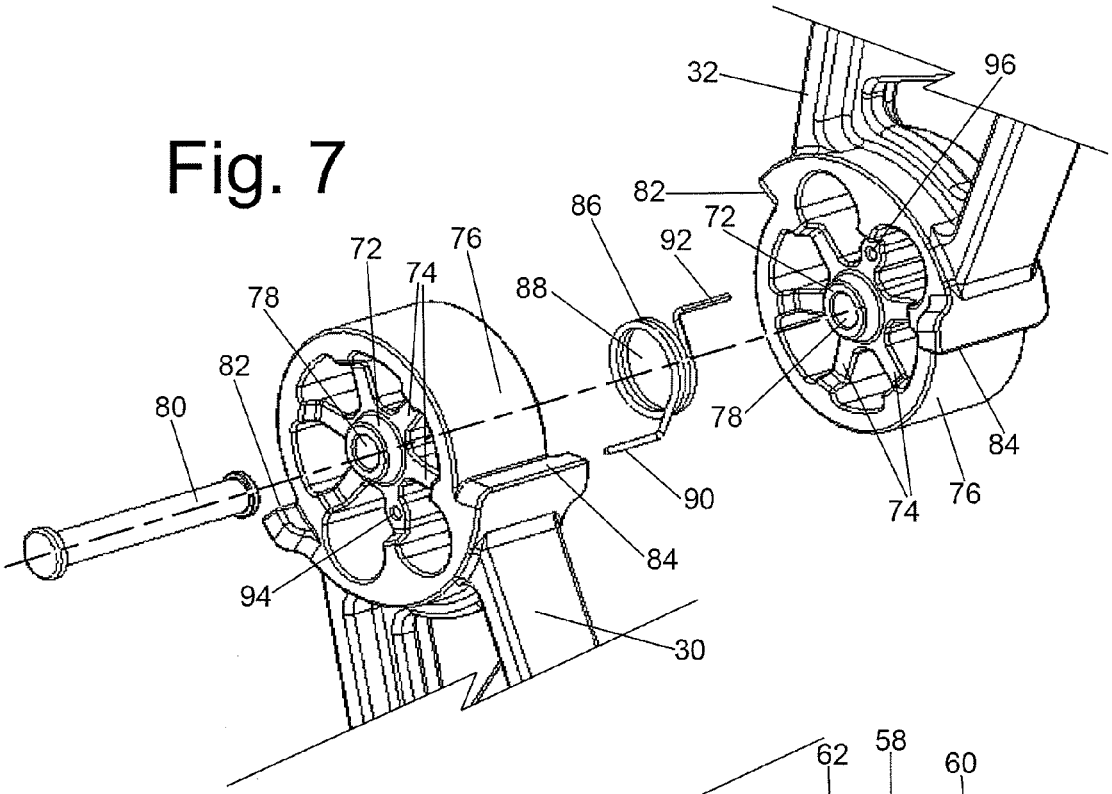
FIG. 7 is an exploded isometric view of the knee joint shown in FIG. 6.
Figure 9:
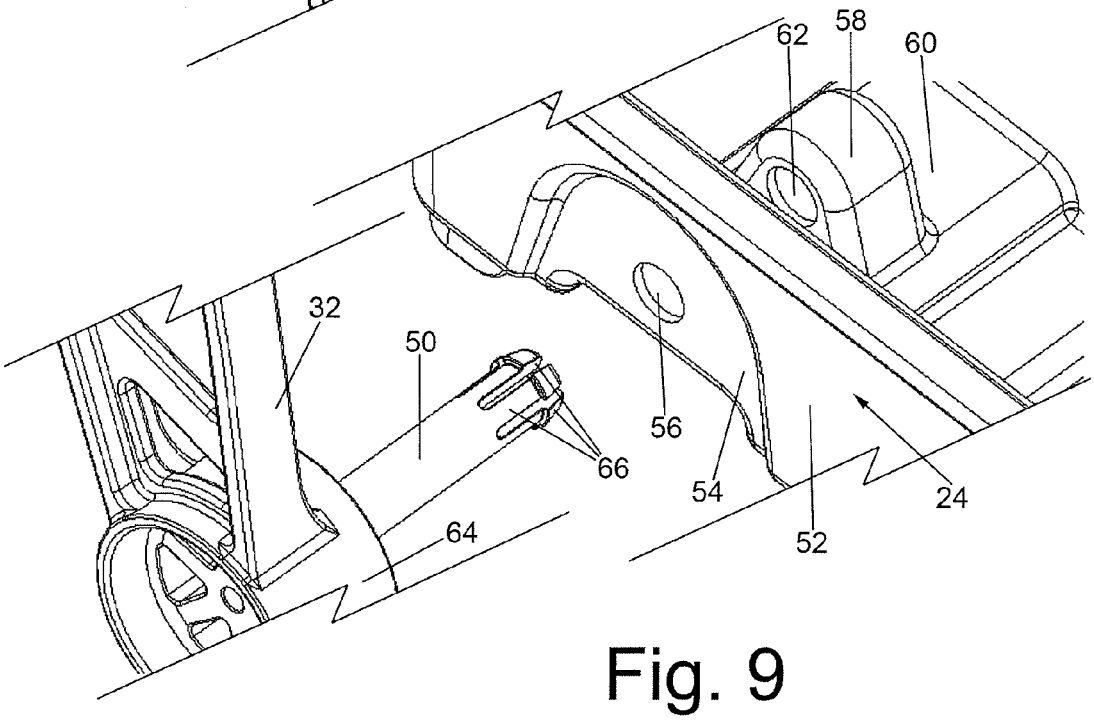
FIG. 9 is an enlarged exploded isometric view showing the connection between the lower end of one strut assembly to the lower tray of the device of FIGS. 1, 2A and 2B.

Referring now to FIGS. 1, 5, 6 and 7, the details of the knee joints 38 and 40 will be described. Each of those joints is of identical construction. Thus, in the interest of brevity only the details of knee joint 38 of the leg assembly 26 will be described. As best seen in FIGS. 6 and 7 the upper end of the leg section 32 is in the form of a circular ring-like structure having a central hub 72 from which plural spokes 74 project to an outer circular surface 76. The lower end of the leg section 30 is of identical construction. Thus, the lower end of the leg section 30 is in the form of a circular ring-like structure having a central hub 72 from which plural spokes 74 project to an outer circular surface 76. A hole 78 is located at the center of each of the hubs 72 for receipt of a pin or rivet 80 (FIGS. 5-7) to pivotably connect the two leg sections together and thereby form the knee joint 38. The outer circular surface 76 of leg section 32 includes a pair of spaced apart projections or stops 82 and 84, as does the outer surface 76 of leg section 30. The stop 82 of the leg section 30 is arranged to abut the stop 82 of the leg section 32, while the stop 84 of the leg section 30 is arranged to abut the stop 84 of the leg section 32 to prevent/restrict the pivoting or folding action of the leg sections to a desired angular range. In particular, when the leg sections are in the extended or open position, such as shown in FIG. 6, the surfaces of the stops 82 contact each other.

As mentioned earlier each knee joint includes a torsion spring. That spring is designated by the reference number 86 and is best seen in FIG. 7. The spring basically comprises a helix of coils having a central passageway 88. The ends of the spring are in the form of linear projections 90 and 92 extending in opposite directions parallel to the central axis of the spring to key the spring to the leg sections 30 and 32. To that end, the linear end portion 90 of the spring is received within a through hole 94 in one of the spokes 74 of the leg section 30, while the linear end portion 92 is received within a through hole 96 in one of the spokes 74 of the leg section 32. The pin or rivet 80 extends through the spring's passageway 88 and through the aligned holes 78 of the leg sections 30 and 32 to complete the knee joint.

As will be appreciated by those skilled in the art when the device 20 is in the extended or open position the effect of gravity and the bias provided by the torsion springs 86 cooperate to rotate the leg sections 30 and 32 of assembly 26 and the leg sections 34 and 36 of assembly 28, so that their respective stop surfaces 82 abut and apply pressure to each other, thereby tending to maintain those leg sections in the extended position ensuring stability of the device. It should be noted that the use of the over-center knee joints with the rotation limiting stops enables the device to be held in its open position by gravity alone. Thus, while the use of the torsion springs is preferred since it provides additional bias to hold the device in the open position, such springs are not mandatory.

In order to facilitate the carrying of the device when it is in its closed or compact condition, a handle 100 (FIGS. 1, 5 and 8) is provided. The handle is centrally positioned and integral to the bottom tray and extends through the upper tray to simplify structural demand on the system when transporting loaded trays. In particular, the handle basically comprises a walled pedestal-like structure projecting upward from the center of the bottom wall 60 of the lower tray. The pedestal-like structure includes four walls which taper upward from the bottom wall 60 of the tray to the top of the pedestal-like structure. The pedestal-like structure is arranged to be received within a complementary walled window 102 in the center of the upper tray 22, when the device is in the closed position. In that position portions of the walls of the pedestal-like structure confront portions of the walls of the window, with the top end of the pedestal-like structure extending above the upper tray 22 as best seen in FIG. 1. A pair of hand-holes 104 are located in opposite walls of the pedestal-like structure adjacent its top. The hand-holes are arranged to receive the fingers of a person carrying the device.

Figure 4:
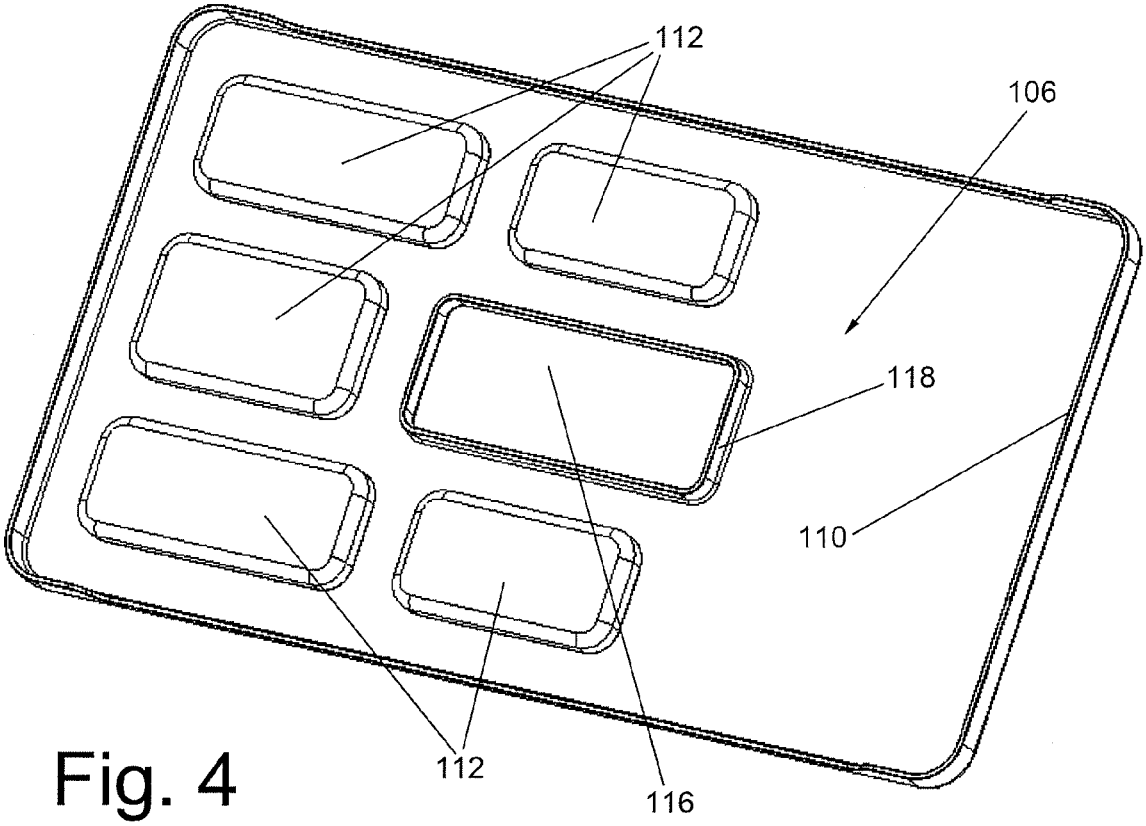
FIG. 4 is an isometric view, taken from the bottom, of the cover shown in FIG. 3.

The upper tray 22 preferably includes a removable cover 106 to ensure that the contents of the upper tray don't fall out. That cover is best seen in FIGS. 3 and 4. The cover 106 includes a top wall 108 of generally rectangular shape corresponding to the profile of the top edge or rim of the sidewall 52 of the upper tray 22. A lip 110 projects downward from the periphery of the top wall 108. The undersurface of the top wall 108 is arranged to be disposed on the top edge of the sidewall 52 of the upper tray to close off the interior of that tray. The top wall 108 includes several depressions or recesses 112, each of which is arranged to receive and hold small items, e.g., hardware (such as screws, nuts, washers, etc.), therein. A portion 114 of the top wall is planar to serve as a writing surface upon which a piece of paper can be placed. In addition, the top wall 108 includes a central opening 116 having a peripheral wall 118, for receipt of the upper portion of the handle 100 when the device is in its closed condition.

Figure 11:
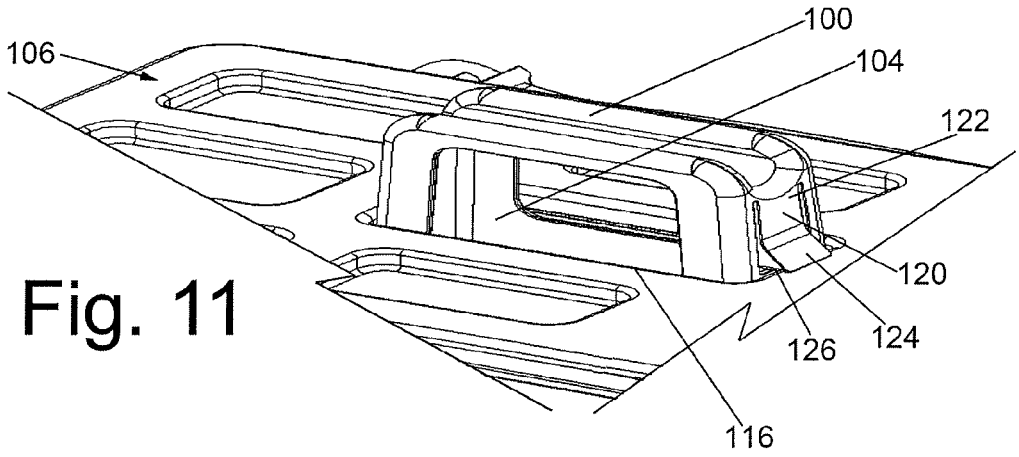
FIG. 11 is an enlarged isometric view showing a portion, e.g., the interconnection between a latch (e.g., a security clip) and the cover of the device of FIG. 1.

In order to hold the device in the closed condition, the device includes a latch or clip 120, which is best seen in FIG. 11. The clip is in the form of a resilient finger 122 that projects out from a wall of the pedestal-like structure 100 adjacent its top. The clip includes a flared free end 124 having a bottom edge or surface 126 which is arranged to overlie a portion of the top wall 108 contiguous with the opening 116 in the cover 106 when the cover is in place and the device 20 is in its closed or compact state. With the clip in place, the device 20 cannot be extended to its open position. When the upper tray is in the closed position, such as shown in FIG. 1, it covers the lower tray to prevent the contents of the lower tray from falling out. Moreover, in this position the upper strut sections 30 and 34 rest against the rim 57 of the lower tray 24.

To deploy or extend the upper tray 22 to its open position, all that the user has to do is to release the clip 120 by simply pressing against the flared outer surface of the clip so that the bottom edge 126 clears the periphery of the opening 116, whereupon the upper tray 22 is released and can be extended to its open position. Conversely, to engage the clip 120 all that the user has to do is to press the upper tray 22 and cover 106 downward, so that the edge of the central opening 116 of the cover rides over the flared outer surface of the free end of the clip, thereby displacing the resilient clip until the lower surface of the peripheral wall 118 of the cover is below the clip's edge 126. At this time the resilient finger forming the clip springs back to its neutral condition, with its bottom edge 126 obstructing upward movement of cover and tray. While not shown, the clip 120 is constructed so that in the event that the cover 106 is not in place, the clip will engage a portion of the upper tray in order to again prevent inadvertent extension of the upper tray without the cover needing to be in place.

Since the top wall 108 of the cover is planar (except for the depressions or recesses 112), it can serve as a base to enable a similarly constructed device 20 to be stacked on it. This arrangement provides more trays for a user to access, with the upper tray being at an even greater height when both are in the open position as shown in FIG. 2B. With such an arrangement the height of the uppermost tray would be readily accessible to someone working on a ladder adjacent the stacked devices.

Figure 12:
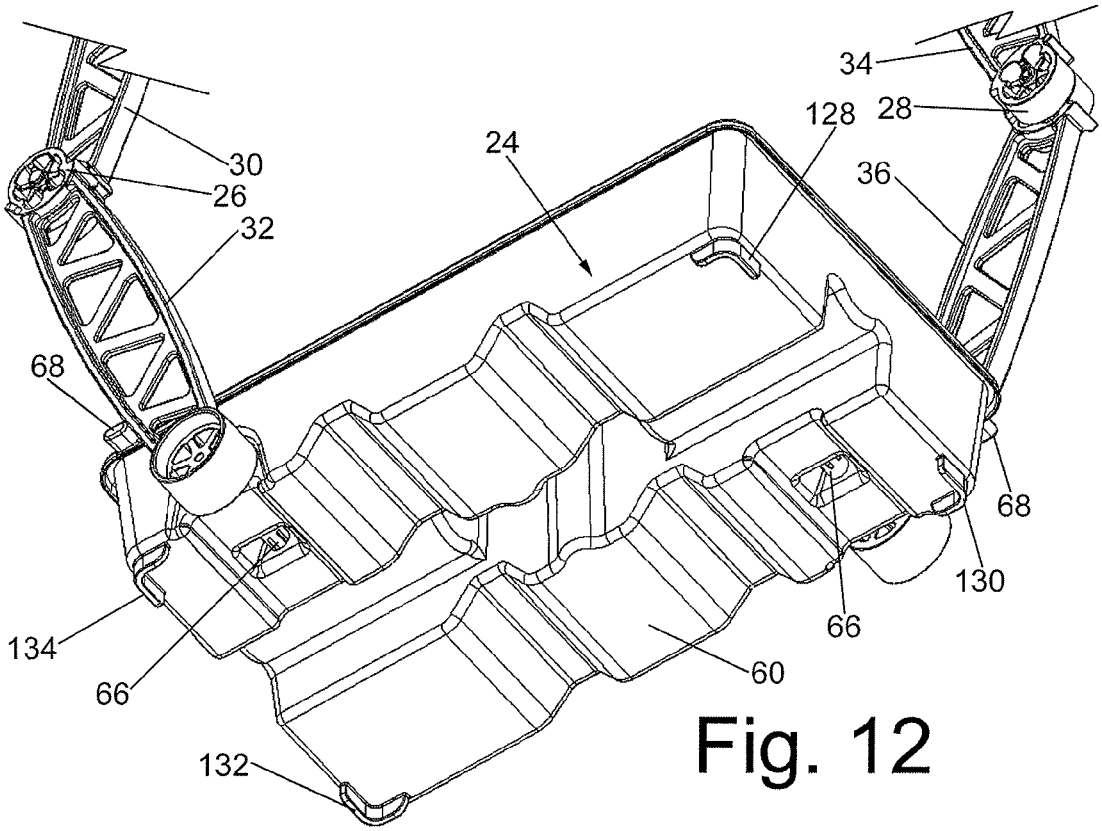
FIG. 12 is an isometric view of the underside of the lower tray of the device shown in FIG. 2A.

In order to facilitate the stacking of two or more devices and prevent the upper one from sliding off of the underlying device, the bottom wall of the lower tray 24 is contoured to include plural projections or feet. In particular, as best seen in FIG. 12 the bottom wall includes four feet 128, 130, 132, and 134 situated at respective corners of bottom surface of tray 24. These feet are shaped to engage respective corners of the cover of an underlying device 20 to align and position the tray on top of the upper tray 22 of the underlying device. Thus, two or more devices can be stacked on top of each other. Moreover, the bottom surfaces of each of the feet are flat and coplanar so that those feet can be disposed directly on the ground or some other support surface, if desired.

As should be appreciated from the foregoing, the preferred embodiment of each leg segment, where connected to the lower or upper tray, has a rigid axle securely integrated or mounted to the respective leg portion and runs through a series of support holes in the bottom or upper tray for purposes of spreading out the forces. This allows for thinner less structural side walls in the trays with strong readily-moldable consistent thickness walls, while increasing their interaction with the leg segments and thus enhancing stability. In the preferred embodiment the axles of the legs are secured in place with a molded-in barbed tip. It should be recognized there are a number of other ways this can be accomplished. Also in the preferred embodiment a rivet is used to join the two adjacent leg segments where they join at the knee joint. Likewise other alternative means can be used to fasten this joint.

It will be recognized that the torsion springs mentioned above will always attempt to influence the upper tray away from the lower tray toward the extended or open position unless some means is offered to counter such bias. In the preferred embodiment a single latch or clip is configured in one side of the handle where it is easily accessed for release of the top tray. As designed the function of the latch is fully automatic in securing the upper tray in the collapsed position. All the user need do to secure the device in its closed state is to ensure that the upper tray, with or without the cover, is collapsed sufficiently to allow engagement of the latch. The configuration of the disclosed preferred embodiment that places the carrying handle integral to the bottom tray not only facilitates a simple means to securing the device in a closed (collapsed and compact) position, but also places the burden of load bearing advantageously on the lower tray, where all the weight of the upper tray and its various contents are easily supported.

In order to elevate the upper tray two folding spring loaded leg assemblies which are simple in construction and efficient in operation are provided. This arrangement is easily manipulated and intuitive to deploy or collapse with minimal effort. The legs, being configured to collapse and fold up alongside the trays, provide an unobtrusive and compact position for more convenient transport and storage. Furthermore this configuration is highly reliable and designed to enhance appearance. While it will be recognized that there are any number of ways to extend and separate the trays from each other (telescoping tubes being one possible arrangement) or to lock the legs in position, such as with knobs, latches, and the like, such structures bring with them extra complexity, cost and operational demands of the user. Thus, the preferred embodiment is constructed as described above. However, this does not rule out the inclusion of additional locking members, such as knobs, etc., where some sacrifice regarding convenience is accepted for the sake of achieving a more robust device.

It should also be noted that wheels or casters may be added to the bottom tray or to an independent structure that supports the lower tray in order to add another level of movement flexibility. Further still, multiple trays of three or more could be employed while adhering to the essence of the current invention furthering the range of storage and height available.

As should be appreciated from the foregoing, the device of this invention is constructed to set it apart from all other previous tool boxes and totes. In particular its extendable top tray feature eliminates the all too common hassle and discomfort of bending and stooping associated with retrieving tools and articles from prior art tool boxes, etc., that rest on the floor or at a height that is well below what is convenient to the user. Further enhancing this unique feature is a design and construction that facilitates quick and easy extension of the top tray and then equally simple and quick collapsing for compact storage and transport.

While devices constructed in accordance with this invention are highly effective in situations not offering suitable or conveniently located tables to rest a tool box or tote tray on, they also have the advantage in other situations. For example they can be used when a user is working on a step ladder. In such an application they can be stacked thereby providing an upper tray that is elevated to twice the height of a single device, thereby reducing the need to climb up and down a ladder to retrieve items to complete the specified task. In such cases additional stability is easily managed, for example, with a clamp securing the devices to a leg of the ladder.

Without further elaboration the foregoing will so fully illustrate my invention that others may, by applying current or future knowledge, adopt the same for use under various conditions of service.

I claim:

1. A device for holding and carrying various items comprising, a lower tray, an upper tray, a first strut assembly, a second strut assembly, and a handle, said handle being connected to one of said trays, said strut assemblies being coupled between said lower tray and said upper tray, each of said strut assemblies having an upper end portion and a lower end portion and comprising a pair of strut sections pivotably connected together, said upper end portion of said first strut assembly being pivotably connected to a first portion of said upper tray, said upper end portion of said second strut assembly being pivotably connected to a second portion of said upper tray, said second portion of said upper tray being located opposite to said first portion of said upper tray, said lower end portion of said first strut assembly being pivotably connected to a first portion of said lower tray, said lower end portion of said second strut assembly being pivotably connected to a second portion of said lower tray, said second portion of said lower tray being located opposite to said first portion of said lower tray, said strut sections of each of said strut assemblies being pivotably connected together and arranged to pivot with respect to each other in a first rotational direction to an open position, whereupon said upper tray is spaced above said lower tray to provide ready access to any items in said lower tray, said strut sections also being arranged to pivot with respect to each other in a second and opposite rotational direction to a closed position, whereupon said upper tray is in close proximity to said lower tray to prevent any items in said lower tray from accidentally falling out of said lower tray, said handle being arranged to facilitate the carrying of said device when said trays are in said closed position, said handle being connected to said lower tray and extending through a portion of said user tray to enable a portion of said handle to be grasped above the user tray.

2. The device of claim 1 wherein said device is arranged for disposition on the ground and wherein said strut assemblies are of a sufficient length so that when said trays are in said open position and said lower tray is located on the ground, said upper tray is at a convenient height for a user to get access to any items in the upper tray without having to bend over.

3. A device for holding and carrying various items comprising, a lower tray, an upper tray, a first strut assembly, a second strut assembly, and a handle, said handle being connected to one of said trays, said strut assemblies being coupled between said lower tray and said upper tray, said strut assemblies being spring loaded and having an upper end portion and a lower end portion and comprising a pair of strut sections pivotably connected together, said upper end portion of said first strut assembly being pivotably connected to a first portion of said upper tray, said upper end portion of said second strut assembly being pivotably connected to a second portion of said upper tray, said second portion of said upper tray being located opposite to said first portion of said upper tray, said lower end portion of said first strut assembly being pivotably connected to a first portion of said lower tray, said lower end portion of said second strut assembly being pivotably connected to a second portion of said lower tray, said second portion of said lower tray being located opposite to said first portion of said lower tray, said strut sections of each of said strut assemblies being pivotably connected together and arranged to pivot with respect to each other in a first rotational direction to an open position, whereupon said upper tray is spaced above said lower tray to provide ready access to any items in said lower tray, said strut sections also being arranged to pivot with respect to each other in a second and opposite rotational direction to a closed position, whereupon said upper tray is in close proximity to said lower tray to prevent any items in said lower tray from accidentally falling out of said lower tray, said handle being arranged to facilitate the carrying of said device when said trays are in said closed position.

4. The device of claim 3 wherein said spring loading of said strut assemblies facilitates the positioning of said trays to said open position.

5. The device of claim 4 wherein said spring loading of said strut assemblies serves to hold said trays in said open position.

6. The device of claim 3 additionally comprising a latch to hold said trays in said closed position.

7. The device of claim 3 wherein said device is a first device and is arranged to be stacked onto a second device, said second device being similar in construction to said first device and with at least one of said first and second devices being in the open position.

8. The device of claim 7 wherein said lower tray includes a lower surface of a predetermined geometry to enable it to be stacked on said second device.

9. The device of claim 3 wherein said second portion of said upper tray is located diagonally to said first portion of said upper tray and said second portion of said lower tray is located diagonally to said first portion of said lower tray.

10. A device for holding and carrying various items comprising, a lower tray, an upper tray, a first strut assembly, a second strut assembly, a cover, and a handle, said handle being connected to one of said trays, said strut assemblies being coupled between said lower tray and said upper tray, said cover being arranged to be disposed over said upper tray, each of said strut assemblies having an upper end portion and a lower end portion and comprising a pair of strut sections pivotably connected together, said upper end portion of said first strut assembly being pivotably connected to a first portion of said upper tray, said upper end portion of said second strut assembly being pivotably connected to a second portion of said upper tray, said second portion of said upper tray being located opposite to said first portion of said upper tray, said lower end portion of said first strut assembly being pivotably connected to a first portion of said lower tray, said lower end portion of said second strut assembly being pivotably connected to a second portion of said lower tray, said second portion of said lower tray being located opposite to said first portion of said lower tray, said strut sections of each of said strut assemblies being pivotably connected together and arranged to pivot with respect to each other in a first rotational direction to an open position, whereupon said upper tray is spaced above said lower tray to provide ready access to any items in said lower tray, said strut sections also being arranged to pivot with respect to each other in a second and opposite rotational direction to a closed position, whereupon said upper tray is in close proximity to said lower tray to prevent any items in said lower tray from accidentally falling out of said lower tray, said handle being arranged to facilitate the carrying of said device when said trays are in said closed position.

11. The device of claim 10 wherein said cover is arranged to be opened to provide access to any items in said upper tray.

12. The device of claim 10 wherein said cover includes at least one recess for receipt of items therein.

13. The device of claim 10 wherein said device is resistant to accidental collapse when said strut assemblies are in said open position.

14. The device of claim 13 wherein said device is capable of being manually collapsed to cause said strut sections to pivot with respect to each other from said open position to said closed position.

15. A device for holding and carrying various items comprising, a lower tray, an upper tray, a first strut assembly, a second strut assembly, and a handle, said handle being connected to one of said trays, said strut assemblies being coupled between said lower tray and said upper tray, each of said strut assemblies having an upper end portion and a lower end portion and comprising a pair of strut sections pivotably connected together, said upper end portion of said first strut assembly being pivotably connected to a first portion of said upper tray, said upper end portion of said second strut assembly being pivotably connected to a second portion of said upper tray, said second portion of said upper tray being located opposite to said first portion of said upper tray, said lower end portion of said first strut assembly being pivotably connected to a first portion of said lower tray, said lower end portion of said second strut assembly being pivotably connected to a second portion of said lower tray, said second portion of said lower tray being located opposite to said first portion of said lower tray, said strut sections of each of said strut assemblies being pivotably connected together and arranged to pivot with respect to each other in a first rotational direction to an open position, whereupon said upper tray is spaced above said lower tray to provide ready access to any items in said lower tray, said strut sections also being arranged to pivot with respect to each other in a second and opposite rotational direction to a closed position, whereupon said upper tray is in close proximity to said lower tray to prevent any items in said lower tray from accidentally falling out of said lower tray, said handle being arranged to facilitate the carrying of said device when said trays are in said closed position said strut sections of each of said strut assemblies are pivotably connected together by an over-center joint including rotation limiting stops, whereupon when said strut assemblies are in the open position the effect of gravity on said device holds said device in the open position.

16. The device of claim 15 wherein each of said over-center joints is spring loaded.

17. The device of claim 16 wherein said spring loading of said over-center joints works in cooperation with gravity to hold said trays in said open position.

18. The device of claim 17 wherein said lower tray additionally comprises rotation limiting stops, said rotation limiting stops of said lower tray cooperating with said rotation limiting stops of said over-center joints to hold said device in the open position.

19. The device of claim 15 wherein said lower tray additionally comprises rotation limiting stops, said rotation limiting stops of said lower tray cooperating with said rotation limiting stops of said over-center joints to hold said device in the open position.

* * * * *